US011525219B2

(12) United States Patent
Warashina

(10) Patent No.: US 11,525,219 B2
(45) Date of Patent: Dec. 13, 2022

(54) HYGIENIC TISSUE PAPER

(71) Applicant: DAIO PAPER CORPORATION, Ehime (JP)

(72) Inventor: Shinichi Warashina, Shizuoka (JP)

(73) Assignee: DAIO PAPER CORPORATION, Ehime (JP)

( * ) Notice: Subject to any disclaimer, the term of this patent is extended or adjusted under 35 U.S.C. 154(b) by 131 days.

(21) Appl. No.: 16/970,022

(22) PCT Filed: Nov. 29, 2018

(86) PCT No.: PCT/JP2018/044046
§ 371 (c)(1),
(2) Date: Aug. 14, 2020

(87) PCT Pub. No.: WO2019/187345
PCT Pub. Date: Oct. 3, 2019

(65) Prior Publication Data

US 2021/0108374 A1 Apr. 15, 2021

(30) Foreign Application Priority Data

Mar. 26, 2018 (JP) ..... JP2018-057879

(51) Int. Cl.
*D21H 27/00* (2006.01)
*A47K 10/16* (2006.01)
(Continued)

(52) U.S. Cl.
CPC ..... *D21H 27/002* (2013.01); *A47K 10/16* (2013.01); *B26F 1/18* (2013.01); *B31F 1/07* (2013.01);
(Continued)

(58) Field of Classification Search
CPC ..... A47K 10/16; B26F 1/18; D21H 27/002; Y10T 428/15; Y10T 428/24314; Y10T 225/12
See application file for complete search history.

(56) References Cited

U.S. PATENT DOCUMENTS 5,562,964 A * 10/1996 Jones ..... B26F 3/002 428/44
5,704,566 A * 1/1998 Schutz ..... A47K 10/38 242/160.1
6,447,864 B2 * 9/2002 Johnson ..... A47K 10/16 221/33
(Continued)

FOREIGN PATENT DOCUMENTS

JP S60-031896 U 3/1985
JP 2003-276936 10/2003
(Continued)

OTHER PUBLICATIONS

Espacenet Translation of JP-2011074530-A (Year: 2022).*
(Continued)

*Primary Examiner* — Michael Zhang
(74) *Attorney, Agent, or Firm* — IPUSA, PLLC

(57) ABSTRACT

A hygienic tissue paper includes first slits that are disposed in a longitudinal direction at predetermined intervals, the first slits extending in a width direction intersecting the longitudinal direction, wherein the first slits each include perforations, and wherein a cut length of each of the perforations increases from at least one end in the width direction toward a central portion in the width direction.

7 Claims, 5 Drawing Sheets

(51) Int. Cl.

| | |
|---|---|
| ***B26F 1/18*** | (2006.01) |
| ***B31F 1/07*** | (2006.01) |
| ***B31F 1/14*** | (2006.01) |

(52) U.S. Cl.
CPC ..... *B31F 1/14* (2013.01); *B31F 2201/0715* (2013.01); *B31F 2201/0756* (2013.01); *Y10T 428/15* (2015.01)

(56) References Cited

U.S. PATENT DOCUMENTS

| | | | | |
|---|---|---|---|---|
| 8,741,410 | B2 | 6/2014 | Cattacin et al. | |
| 2001/0000737 | A1* | 5/2001 | Johnson | A47K 10/16 428/43 |
| 2008/0280088 | A1* | 11/2008 | Baum | A47K 10/16 225/2 |

FOREIGN PATENT DOCUMENTS

| | | | | |
|---|---|---|---|---|
| JP | 2004-049261 | | 2/2004 | |
| JP | 2011-074530 | | 4/2011 | |
| JP | 2011074530 A | * | 4/2011 | B31F 1/07 |
| WO | 2009/060237 | | 5/2009 | |

OTHER PUBLICATIONS

Extended European Search Report for 18912722.8 dated Oct. 29, 2021.

International Search Report dated Jan. 29, 2019 with respect to PCT/JP2018/044046 filed on Nov. 29, 2018.

Office Action dated Jan. 22, 2019 with respect to the corresponding Japanese Patent Application No. 2018-057879.

* cited by examiner

HYGIENIC TISSUE PAPER

TECHNICAL FIELD

The present invention relates to hygienic tissue paper.

BACKGROUND ART

Hygienic tissue paper, such as a kitchen paper, may be used as a tissue paper roll with sheets being wound in a roll. On the rolled sheet, perforations crossing the longitudinal direction are formed at predetermined intervals in the longitudinal direction. Such a tissue paper roll is disposed at a holder, for example, and by cutting the tissue paper roll at the perforations formed on the sheet, a cut portion of the sheet is used as hygienic tissue paper.

CITATION LIST

Patent Document

[Patent Document 1] Japanese Unexamined Patent Application Publication No. 2004-49261

SUMMARY OF INVENTION

Problem to be Solved by the Invention

However, in the conventional hygienic tissue paper, when a sheet is cut off in a state in which a tissue paper roll is disposed at the holder for example, the sheet may tear or an extra sheet may be pulled out because the sheet cannot be cut properly at a position where the perforations are formed.

An object of the present invention is to provide hygienic tissue paper that is easily cut off.

Means for Solving Problems

One aspect of the present invention provides hygienic tissue paper including first slits that are disposed in a longitudinal direction at predetermined intervals, the first slits extending in a width direction intersecting the longitudinal direction, wherein the first slits each include perforations, and wherein a cut length of each of the perforations increases from at least one end in the width direction toward a central portion in the width direction.

Advantageous Effects of Invention

According to one aspect of the present invention, it is possible to provide hygienic tissue paper that is easily cut off.

DESCRIPTION OF EMBODIMENTS

Figure 1:
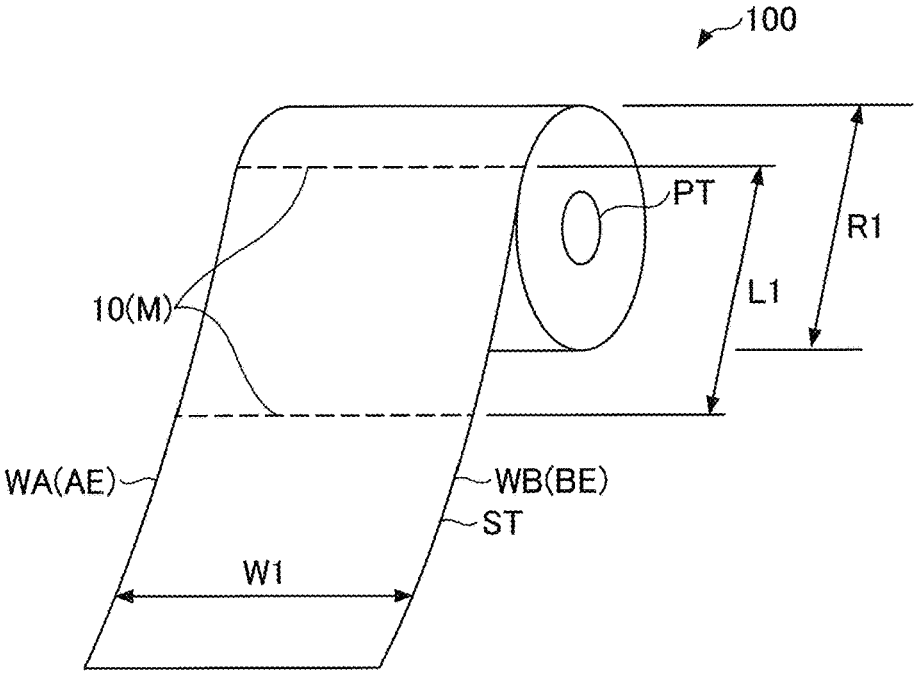
FIG. 1 is a drawing illustrating hygienic tissue paper according to an embodiment (a first embodiment) of the present invention.

In the following, embodiments of the present invention will be described in detail with reference to the drawings. It should be noted that for ease of understanding, the scale of each member in each figure may differ from the actual scale in the present specification. In the description below, a part common in each figure may be referenced by the same reference numeral and a description may be omitted.

In the present specification, a three-dimensional orthogonal coordinate system in three axes (i.e., X, Y, and Z directions) is used. In the specification, the X direction indicates a direction intersecting (or orthogonal to) a longitudinal direction (i.e., a drawing direction) of hygienic tissue paper, the Y direction indicates the longitudinal direction (i.e., the drawing direction) of hygienic tissue paper, and the Z direction indicates a thickness direction of hygienic tissue paper.

Figure 2:
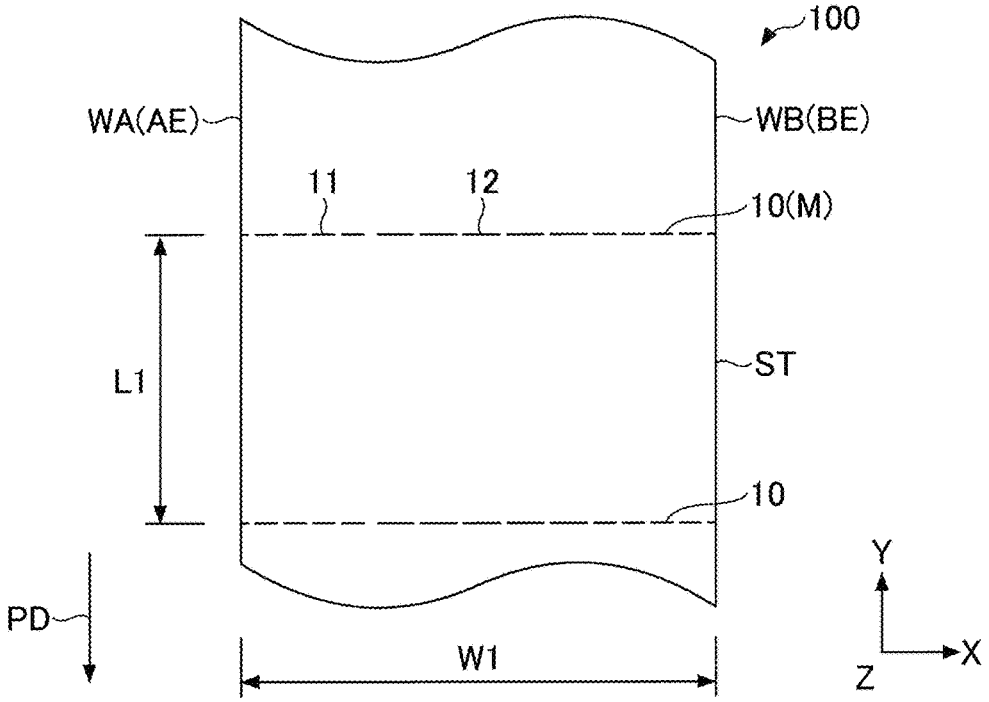
FIG. 2 is a drawing of an enlarged part of the hygienic tissue paper according to the first embodiment when viewed in a thickness direction.
Figure 3:
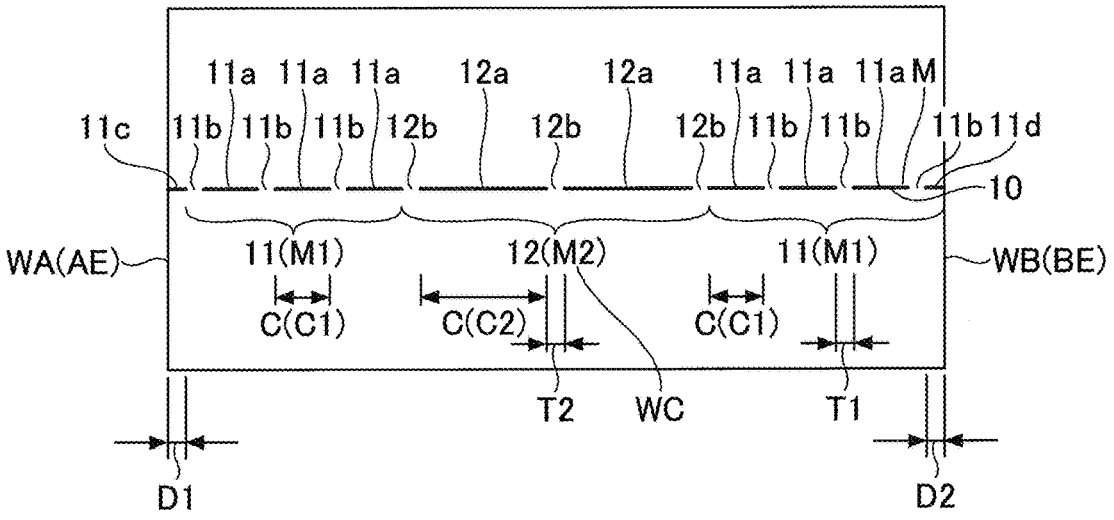
FIG. 3 is an enlarged view of a first slit (i.e., a first perforation and a second perforation) of the hygienic tissue paper according to the first embodiment.

FIG. 1 is a drawing illustrating hygienic tissue paper according to an embodiment of the present invention (i.e., a first embodiment). FIG. 2 is a drawing of an enlarged part of the hygienic tissue paper according to the first embodiment viewed in the thickness direction (i.e., the Z direction). FIG. 3 is an enlarged view of a first slit (i.e., a first perforation and a second perforation) of the hygienic tissue paper according to the first embodiment.

In FIG. 1, a reference numeral 100 indicates a kitchen paper, which is an example of the hygienic tissue paper according to the present invention. An aspect of the hygienic tissue paper (e.g., the kitchen paper 100) is not particularly limited. For example, a roll of kitchen paper (which will be hereinafter referred to as a tissue paper roll or a kitchen roll) as illustrated in FIG. 1, may be used. The roll of kitchen paper 100 is paper wound around a paper tube PT, on which first slits 10 (i.e., perforations M) are formed on a band-shaped sheet ST at predetermined intervals L1 as illustrated in FIG. 1.

Figure 5:
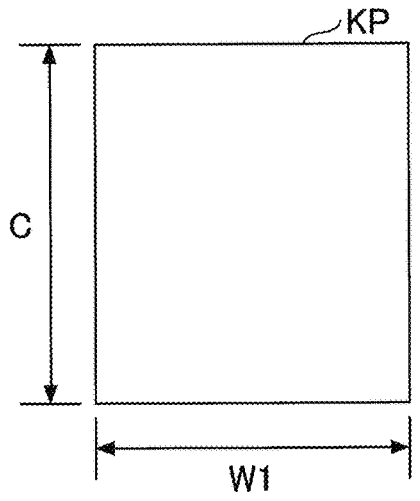
FIG. 5 is a drawing illustrating a usage state (after being cut off) of the hygienic tissue paper according to the first embodiment.

In such a roll of the kitchen paper 100, a single sheet of kitchen paper KP is obtained by pulling out the wound sheet ST and cutting the sheet ST along perforations M (see FIG. 5). Such a usage form may be referred to as a pickup type.

The hygienic tissue paper according to the present embodiment is not limited to kitchen paper, and can be applied to hygienic tissue paper such as tissue paper and paper towels. Such hygienic tissue paper is not limited to dry hygienic tissue paper, and includes moistened hygienic tissue paper impregnated with water or chemicals. Applications of the hygienic tissue paper can be for both household use and commercial use.

The dimensions of the hygienic tissue paper (e.g., the kitchen paper) 100 are not particularly limited. For example, in the kitchen roll illustrated in FIGS. 1 and 2, the roll diameter R1 is 70 mm to 150 mm, the roll width W1 is 100 mm to 300 mm, the interval L1 between the perforations M is 100 mm to 300 mm, and the sheet ST thickness (2-ply) is 100 μm to 1100 μm.

The sheet ST constituting the hygienic tissue paper (e.g., the kitchen paper) 100 is formed of crepe paper. The crepe paper is paper with small wrinkles being formed on a surface of the paper by applying a blade, which is called a doctor blade, at an exit of a dryer of a papermaking machine in the papermaking process.

For the crepe paper constituting the sheet ST, paper mainly made from pulp as a raw material, is used. For the composition of pulp, any publicly known composition of the kitchen paper can be used. For example, the compounding ratio of pulp may be 50 mass % or greater, preferably 90 mass % or greater, and more preferably 100 mass %.

With respect to the composition of pulp in the crepe paper, softwood pulp, such as needle bleached kraft pulp (NBKB) or needle unbleached kraft pulp (NUKP), and a hardwood pulp, such as leaf bleached kraft pulp (LBKP) or leaf unbleached kraft pulp (LUKP), may be mixed at appropriate ratios. In particular, the composition of pulp preferably contains a higher ratio of softwood pulp to hardwood pulp. The ratio of softwood pulp to hardwood pulp is preferably 50:50 to 80:20.

The basis weight of the crepe paper is not particularly limited, but, for example, the basis weight ($g/m^2$) measured in accordance with JIS P 8124 (1998) can be adopted. When hygienic tissue paper is the kitchen paper 100, the basis weight of the crepe paper constituting the hygienic tissue paper is preferably 14.0 to 50.0 $g/m^2$, more preferably 15.0 to 30.0 $g/m^2$, and particularly preferably 16.0 to 24.0 $g/m^2$, per single ply.

Additionally, the paper thickness of the crepe paper is not particularly limited, but, for example, the paper thickness measured under the environment of JIS P 8111 (1998) can be adopted. When hygienic tissue paper is the kitchen paper 100, the paper thickness of the crepe paper is 50 to 550 μm, preferably 150 to 500 μm, and more preferably 200 to 330 μm, per single ply.

With respect to a measurement method for the paper thickness, after a test piece is sufficiently moistened under conditions of JIS P 8111 (1998), the measurement is performed in a 2-ply state under the same conditions, using a dial thickness gauge (thickness measurement instrument) "PEACOCK TYPE G" (manufactured by OZAKI MFG. CO., LTD). Specifically, after confirming that there is, for example, no dust or dirt between a plunger and a measurement table, the plunger is lowered onto the measurement table, and the scale of the dial thickness gauge is moved to adjust the zero point. Next, the plunger is raised, and the test piece is placed on the test table. Then, the plunger is slowly lowered, and the gauge is read. At this step, the plunger is simply placed on the test piece. An end part of the plunger is made of a metal and the end part is placed on the test piece such that a circular flat surface of the end part, having a diameter of 10 mm, contacts the test piece with being orthogonal to a paper surface. When the paper thickness is measured, a load is about 70 gf. The paper thickness is an average value based on ten measurements.

A single ply of the crepe paper constituting the sheet ST, may be subjected to an embossing process. Such a embossing process forms a convex embossment on one surface of the crepe paper by pressing a convex embossing roll (not illustrated), against the crepe paper using, for example, a publicly known steel rubber embossing method. Concave embossing corresponding to the convex embossing is formed on the other surface of the crepe paper.

The shape of the top of the convex embossing formed on the crepe paper (or an opening of the concave embossing corresponding to the convex embossing) is not particularly limited. For example, the shape may be a square shape, a triangle shape, or a circle shape, in planar view. A side surface of the convex embossing is preferably tapered from the surface of the crepe paper where the convex embossing is not formed toward the top of the convex embossing, which is not illustrated. By providing the convex embossing having such a tapered side surface, the kitchen paper 100 is not easily compressed in the thickness direction (i.e., in the Z direction).

The number of plies of the sheet ST constituting the hygienic tissue paper (e.g., the kitchen paper) 100 is not particularly limited, can be greater than or equal to one, and is preferably two (i.e., two layers). The shape of the hygienic tissue paper is not particularly limited. For example, the planar contour shape is preferably a rectangle. The hygienic tissue paper (e.g., the kitchen paper 100) according to the present embodiment is formed of two pieces (two layers) of the crepe paper having the convex embossing described above.

Specifically, the kitchen paper 100 of the present embodiment has a laminated structure in which two sheets of the crepe paper with the convex embossing being formed, are laminated and integrated. A form of such a laminated structure is not particularly limited, and a tip-to-tip type laminated structure employed in a laminated structure of the conventional kitchen paper, a nested type laminated structure, or the like, can be employed.

Such a laminated structure can also be formed by bonding two sheets of the crepe paper with an adhesive. For such an adhesive, a publicly known adhesive employed in the kitchen paper having a laminated structure, can be used. Such an adhesive includes cellulosic adhesives such as polyvinyl alcohol, starch, modified starch, and carboxymethylcellulose.

As illustrated in FIGS. 1 and 2, the hygienic tissue paper 100 according to the present embodiment (i.e., the first embodiment) includes the first slits 10 that are disposed in the longitudinal direction (i.e., the Y direction) at the predetermined intervals L1 and that extend in the width direction (i.e., the X direction) intersecting the longitudinal direction (i.e., the Y direction). As illustrated in FIGS. 2 and 3, the first slit 10 includes perforations M, and a cut length C of each of the perforations M increases from at least the one end WA in the width direction toward a central portion WC in the width direction. Additionally, the cut length of each of the perforations M increases from the other end WB facing the one end WA in the width direction (i.e., in the X direction) toward the central portion WC.

Further, as illustrated in FIGS. 2 and 3, in the hygienic tissue paper 100 according to the first embodiment, the first slit 10 includes a first perforation 11 (M1) formed on the one end WA side and on the other end WB side, and a second perforation 12 (M2) formed on the central portion WC. A cut length C2 of the second perforation 12 (M2) is longer than a cut length C1 of the first perforation 11 (M1).

The first perforation M1 constituting the first slit 10 has a structure in which a portion that has been cut (a cut portion) 11*a* and a portion that is not cut (a tie portion) lib between two adjacent cut portions 11*a* are alternately disposed, as illustrated in FIG. 3. The second perforation M2 has a structure in which a cut portion 12*a* and a tie portion 12*b* are alternately disposed.

In the hygienic tissue paper 100 of the first embodiment, a cut-tie ratio CT1 of the first perforation 11 (M1) is preferably 80.0 to 96.0, more preferably 81.0 to 95.0, and further more preferably 82.0 to 94.0. The cut-tie ratio CT1 is a ratio of the length of the cut portion 11*a* to a unit length that is the length of the cut portion 11*a* and the tie portion 11*b* adjacent to the cut portion 11*a* in a direction in which the first perforation M1 extends, where the unit length is 100.

From a different viewpoint, in the hygienic tissue paper 100 of the first embodiment, a tie-cut ratio TC1 of the first perforation 11 (M1) is preferably 0.05 to 0.23, more preferably 0.06 to 0.22, and further more preferably 0.07 to 0.21. The tie-cut ratio TC1 is a ratio of the length (the tie length) T1 of the tie portion lib to the length (the cut length) C1 of the cut portion 11*a* in the direction in which the first perforation M1 extends.

In the present specification, the length of the cut portion (i.e., the cut length) is the length of the cut portion constituting each of the perforations in the width direction (i.e., in the X direction). The length of the tie portion (i.e., the tie length) is the length of the tie portion constituting each of the perforations in the width direction (i.e., in the X direction).

Additionally, in the first embodiment, a cut-tie ratio CT2 of the second perforation 12 (M2) is preferably 87.0 to 99.0, more preferably 88.0 to 98.0, and further more preferably 89.0 to 97.0. The cut-tie ratio CT2 is a ratio of the length of the cut portion 12*a* to a unit length that is the length of the cut portion 12*a* and the tie portion 12*b* adjacent to the cut portion 12*a* in a direction in which the second perforation M2 extends, where the unit length is 100.

From a different viewpoint, in the hygienic tissue paper 100 of the first embodiment, a tie-cut ratio TC2 of the second perforation 12 (M2) is preferably 0.01 to 0.13, more preferably 0.02 to 0.12, and further more preferably 0.03 to 0.11. The tie-cut ratio TC2 is a ratio of the length (the tie length) T2 of the tie portion 12*b* to the length (the cut length) C2 of the cut portion 12*a* in the direction in which the second perforation M2 extends.

Further, in the hygienic tissue paper 100 according to the first embodiment, the first perforation 11 (M1) includes an edge cut portion 11*c* on the one end WA that continues from an edge AE of the one end WA. The ratio of an edge cut length D1 of the edge cut portion 11*c* to the cut length C1 of the first perforation 11 (M1) is preferably 0.02 to 0.16, more preferably 0.05 to 0.13, and further more preferably 0.07 to 0.11. The ratio of the edge cut length D1 to the cut length C1 (i.e., the D1 ratio) indicates a ratio of the edge cut length D1 when the cut length C1 is 1 (see FIG. 3).

The first perforation 11 (M1) includes an edge cut portion 11*d* at the other end WB that continues from an end edge BE of the other end WB. The ratio of the edge cut length D2 of the edge cut portion 11*d* to the cut length C1 of the first perforation 11 (M1) is preferably 0.02 to 0.16, more preferably 0.05 to 0.13, and further more preferably 0.07 to 0.11. The ratio of the edge cut length D2 to the cut length C1 (i.e., the D2 ratio) indicates a ratio of the edge cut length D2 when the cut length C1 is 1 (see FIG. 3).

Figure 4:
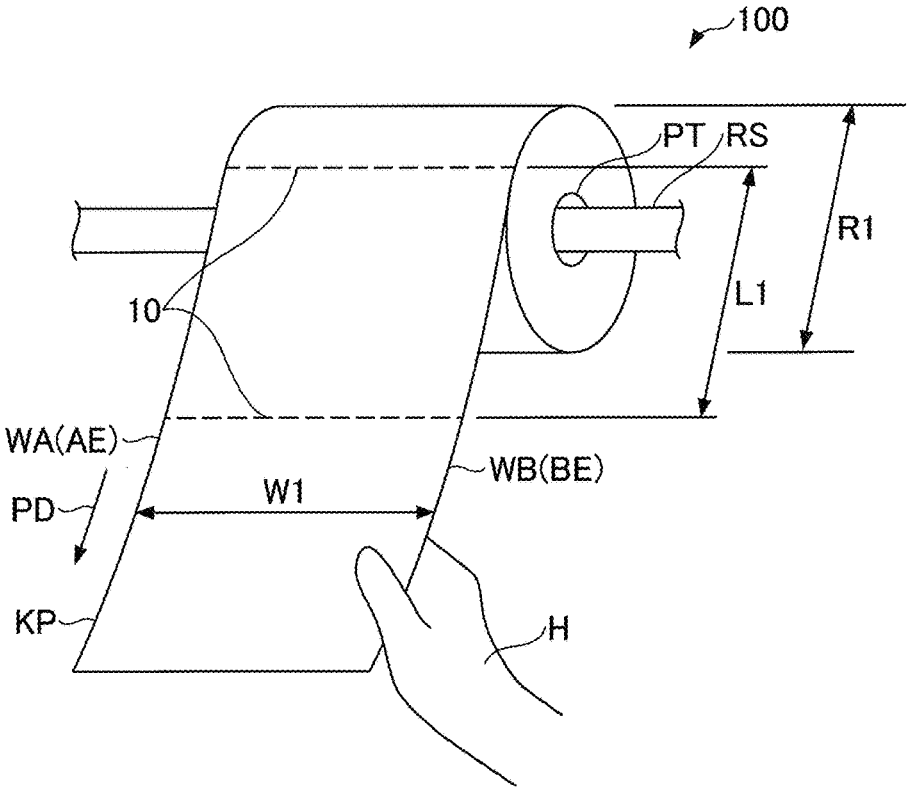
FIG. 4 is a drawing illustrating a usage state (before being cut off) of the hygienic tissue paper according to the first embodiment.

FIGS. 4 and 5 are drawings each illustrating a state of a usage state of the hygienic tissue paper according to the first embodiment. Here, the effect according to the present embodiment will be described with reference to FIGS. 4 and 5. In the hygienic tissue paper 100 according to the first embodiment, as described above, the first slits 10 that are disposed in the longitudinal direction (i.e., the Y direction) at the predetermined intervals L1 and that extend in the width direction (i.e., the X direction) intersecting the longitudinal direction (i.e., the Y direction), are formed. Then, the first slit 10 includes the perforations M, and the cut length C of each of the perforations M increases from the one end WA and the other end WB in the width direction toward the central portion WC in the width direction (see FIGS. 1 to 3).

With such a configuration, in the first embodiment, the kitchen paper 100 can be cut off at the position where the perforations M are formed even in a state in which the kitchen paper 100 is not fixed or is unstable. Specifically, as illustrated in FIG. 4, when the kitchen paper 100 is the kitchen paper roll (i.e., the tissue paper roll), the tissue paper roll is rotatably mounted to a holder (i.e., a support bar RS). Then, a front end of the kitchen paper 100 mounted to the support bar RS is bolded by one hand H, and the kitchen paper KP is cut from the tissue paper roll with the kitchen paper 100 being pulled out in the direction PD. At this time, in the kitchen paper 100, one sheet of the kitchen paper KP can be cut using one hand H without the tissue paper roll of the kitchen paper 100 being pressed down.

If the tissue paper roll, such as the kitchen roll, is used when mounted to a holder, the holder is not limited to a holder in which a support bar extends in the width direction (i.e., a right and left direction) as illustrated in FIG. 4 above, but may be a support bar that extends in a vertical direction (an up and down direction). Alternatively, the support bar of the holder may be a support bar that extends either in the left direction or the right direction. In the embodiment illustrated in FIG. 4, the one hand H holding the kitchen paper 100 is a right hand, but the kitchen paper 100 may be held and cut using the left hand.

As described, the kitchen paper 100 of the present embodiment is not easily torn at an unexpected position when the kitchen paper 100 is cut, and the kitchen paper KP can be properly cut off (see FIG. 5). The kitchen paper 100 also enables the hygienic tissue paper KP to be cut at the predetermined intervals L1 and can prevent extra kitchen paper 100 from being pulled out. Therefore, the kitchen paper 100 according to the first embodiment is easily cut.

In the first embodiment, in the first slit 10 as described above, the cut length C of each of the perforations M increases from the other end WB facing the one end WA in the width direction (i.e., the X direction) toward the central portion WC (see FIGS. 1 to 3). Thus, when the kitchen paper KP is cut off, the kitchen paper KP can be cut off from either the one end WA or the other end WB of the kitchen paper 100. Therefore, according to the first embodiment, the convenience of the kitchen paper KP is improved.

In the first embodiment, the first slit 10 includes the first perforation 11 (M1) formed on the one end WA side and the other end WB side in the width direction, and the second perforation 12 (M2) formed on the central portion WC. The cut length C2 of the second perforation 12 (M2) is longer than the cut length C1 of the first perforation 11 (M1).

With such a configuration, in the first embodiment, the cut length C of each of the perforations M can increases from each of the one end WA and the other end WB toward the central portion WC. With such a configuration, the kitchen paper KP starts to be cut at the one end WA side or the other end WB side in the width direction (i.e., the X direction) and a cutting direction proceeds toward the central portion WC in the width direction (i.e., the X direction). At this time, the cutting direction is gradually stabilized as the cutting direction proceeds from the perforation M1 having a short cut length (i.e., the first perforation 11) on the one end WA side or the other end WB side to the perforation M2 having a long cut length (i.e., the second perforation 12) on the central portion WC. When the cutting proceeds to reach the other end WB side or the one end WA side in the width direction (i.e., the X direction) from the central portion WC, the cutting can proceed with the cutting direction being stable.

In the first embodiment, when the hygienic tissue paper 100 (KP) is cut off, a force applied to the perforations M is easily transmitted from the first perforation 11 (M1) to the second perforation 12 (M2). Even when the kitchen paper KR is cut from either the one end WA or the other end WB in the width direction (i.e., the X direction), this can prevent the perforations M from being torn in an unexpected direction and can prevent extra hygienic tissue paper 100 (KP) from being pulled out without the perforations M being cut.

In the first embodiment, when the cut-tie ratio CT1 of the first perforation 11 (M1) is within the above-described range, when the hygienic tissue paper 100 (KP) is cut off, the force applied to the perforations M is easily transmitted from the first perforation 11 (M1) to the second perforation 12 (M2). Therefore, the first embodiment can further prevent the perforations M from being torn in an unexpected direction and can prevent extra hygienic tissue paper from being pulled out without the perforations M being cut.

From a different viewpoint, in the first embodiment, the tie-cut ratio TC1 of the first perforation 11 (M1) is configured to be in the above-described range, so that when the hygienic tissue paper 100 (KP) is cut off, the force applied to the perforations M is more easily transmitted from the first perforation 11 (M1) to the second perforation (M2). Therefore, the first embodiment can further prevent the perforations M from being torn in an unexpected direction and prevent extra hygienic tissue paper 100 from being pulled out without the perforations M being cut.

Further, in the first embodiment, the cut-tie ratio CT2 of the second perforation 12 (M2) is configured to be in the above-described range, so that when the hygienic tissue paper 100 (KP) is cut off, the force applied to the perforations M is further easily transmitted from the first perforation (M1) to the second perforation 12 (M2). Therefore, the first embodiment can further prevent the perforations M from being torn in an unexpected direction and prevent extra hygienic paper from being pulled out without the perforations M being cut.

From a different viewpoint, in the first embodiment, the tie-cut ratio TC2 of the second perforation 12(M2) is configured to be in the above-described range, so that when the hygienic tissue paper 100 (KP) is cut off, the force applied to the perforations M is further easily transmitted from the first perforation 11 (M1) to the second perforation (M2). Therefore, the first embodiment can further prevent the perforations M from being torn in an unexpected direction and prevent extra hygienic tissue paper 100 from being pulled out without the perforations M being cut.

In the first embodiment, the first perforation 11 (M1) includes the edge cut portion 11*c* that continues from the edge AE of the one end WA in the width direction (i.e., the X direction). The first perforation 11 (M1) also includes the edge cut portion 11*d* that continues from the edge BE of the other end WB in the width direction (i.e., the X direction). Thus, in the first embodiment, the force applied to the perforations M is easily transmitted from the edge AE of the one end WA or the edge BE of the other end WB to the first perforation 11 (M1). Therefore, according to the first embodiment, even when the kitchen paper KR is cut off from either the one end WA or the other end WB in the width direction (i.e., the X direction), the entire perforations M becomes easy to be cut and the hygienic tissue paper 100 (KP) is further easily cut off.

In the first embodiment, the D1 ratio (i.e., the ratio of the edge cut length D1 to the cut length C1) is configured to be in the above-described range, so that when the hygienic tissue paper 100 (KP) is cut off, the force applied to the perforations M is more easily transmitted from the edge AE of the one end WA to the first perforation 11 (M1). Additionally, the D2 ratio (i.e., the ratio of the edge cut length D2 to the cut length C1) is configured in the above-described range, so that even when the kitchen paper KR is cut off from either the one end WA or the other end WB in the width direction (i.e., the X direction), the force applied to the perforations M is more easily transmitted from each of the edge BA of the one end WA and the edge BE of the other end WB to the first perforation 11 (M1). Thus, according to the first embodiment, when the hygienic tissue paper 100 is cut off, the entire perforations M become easy to be cut and the hygienic tissue paper 100 (KP) is more easily cut off.

With such a configuration, in the first embodiment, both the edge cut portion 11*c*, which continues from the edge AE (BE) of the one end WA of the hygienic tissue paper 100 (KP) in the width direction (i.e., the X direction), and the edge cut portion 11*d*, which continues from the edge BE of the other end WB, are not easily turned over. Therefore, according to the first embodiment, unexpected breaks or product defects of the hygienic tissue paper 100 (KP) during the manufacturing or packaging process of the hygienic tissue paper 100 can be avoided.

Figure 6:
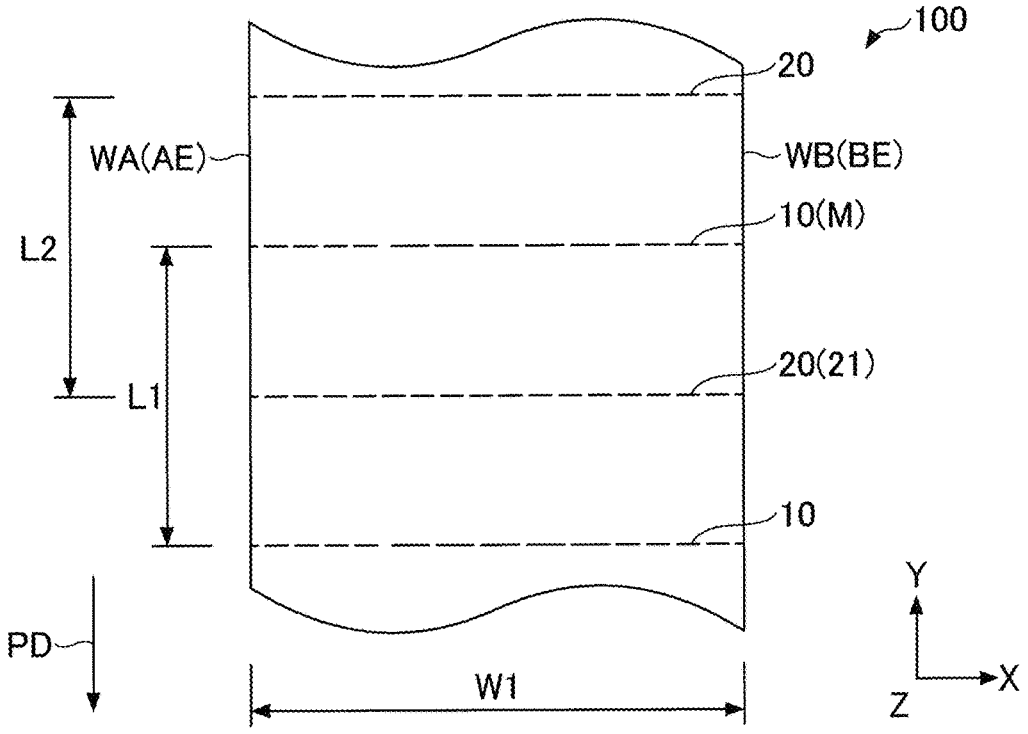
FIG. 6 is a drawing of an enlarged part of hygienic tissue paper according to an embodiment (a second embodiment) of the present invention when viewed in a thickness direction.
Figure 7:
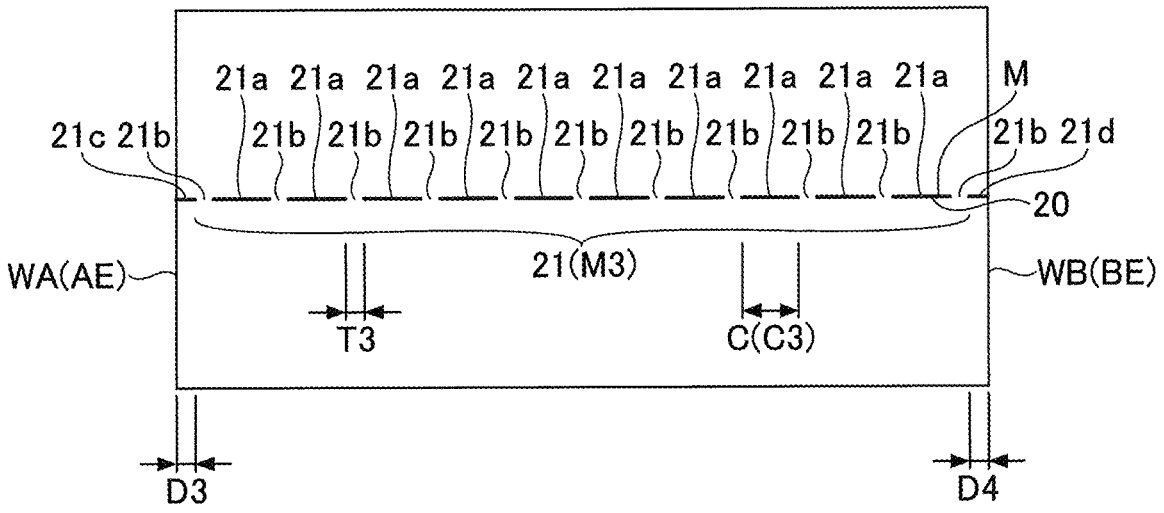
FIG. 7 is an enlarged view of a second slit (i.e., a third perforation) of the hygienic tissue paper according to the second embodiment.

FIG. 6 is a drawing of an enlarged part of hygienic tissue paper according to an embodiment (i.e., a second embodiment) of the present invention when viewed in the thickness direction (i.e., the Z direction). FIG. 7 is an enlarged view of a second slit (i.e., a third perforation) of the hygienic tissue paper according to the second embodiment.

As illustrated in FIGS. 6 and 7, the hygienic tissue paper 100 according to the present embodiment (i.e., the second embodiment) includes a second slit 20 that is alternately disposed with each of the first slits 10 in the longitudinal direction (i.e., the Y direction) at a predetermined interval L2 and that extends in the width direction (i.e., the X direction) intersecting the longitudinal direction (i.e., the Y direction), the second slit 20 includes a third perforation 21 (M3), and a cut length C3 of the third perforation 21 (M3) is the same as the cut length C1 of the first perforation (M1) in the first slit 10 or is shorter than the cut length C1.

In the hygienic tissue paper 100 of the second embodiment, the second slit 20 extending in the width direction (i.e., the X direction) intersecting the longitudinal direction (i.e., the Y direction) is alternately disposed with each of the first slits 10 at the predetermined interval L2 in the longitudinal direction (i.e., the Y direction). The cut length C3 of the third perforation 21 (M3) constituting the second slit 20 is the same as the cut length C1 of the first perforation 11 (M1) in the first slit 10 or is shorter than the cut length C1.

In the second embodiment, the third perforation M3 constituting the second slit 20 has a structure in which a cut portion 21*a* and a tie portion 21*b* are alternately disposed as illustrated in FIG. 7. In the second embodiment illustrated in FIG. 7, the third perforation 21 (M3) includes an edge cut portion 21*c* that continues from the edge AE of the one end WA at the one end WA and an edge cut portion 11*d* that continues from the edge BE of the other end WB at the other end WB.

The ratio of an edge cut length D3 of the edge cut portion 21*c* to the cut length C3 of the third perforation 21 (M3) is preferably 0.02 to 0.16, more preferably 0.05 to 0.13, and further more preferably 0.07 to 0.11. The ratio of the edge cut length D3 to the cut length C3 (i.e., a D3 ratio) indicates a ratio of the edge cut length D3 when the cut length C3 is 1 (see FIG. 7).

The ratio of an edge cut length D4 of the edge cut portion 21*d* to the cut length C3 of the third perforation 21 (M3) is preferably 0.02 to 0.16, more preferably 0.05 to 0.13, and further more preferably 0.07 to 0.11. The ratio of the edge cut length D4 to the cut length C3 (i.e., a D4 ratio) indicates a ratio of the edge cut length D4 when the cut length C3 is 1 (see FIG. 7).

In the second embodiment, as illustrated in FIGS. 4 and 5, a sheet of the kitchen paper KP that is cut off along the first slit 10 (i.e., the first perforation 11 (M1) and the second perforation 12 (M2)) is cut off at the predetermined interval L1. Then, the second slit 20 (i.e., the third perforation 21 (M3)) is left in the kitchen paper KP that has been cut off (see FIGS. 6 to 8).

Figure 8:
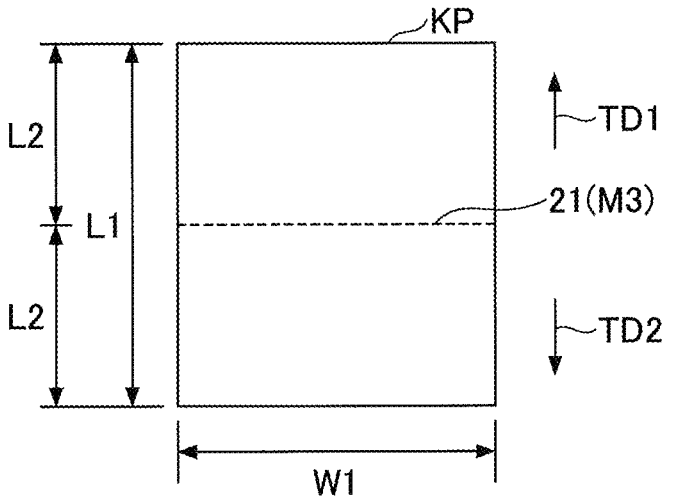
FIG. 8 is a drawing illustrating a usage state (before being cut off) of the hygienic tissue paper according to the second embodiment.
Figure 9:
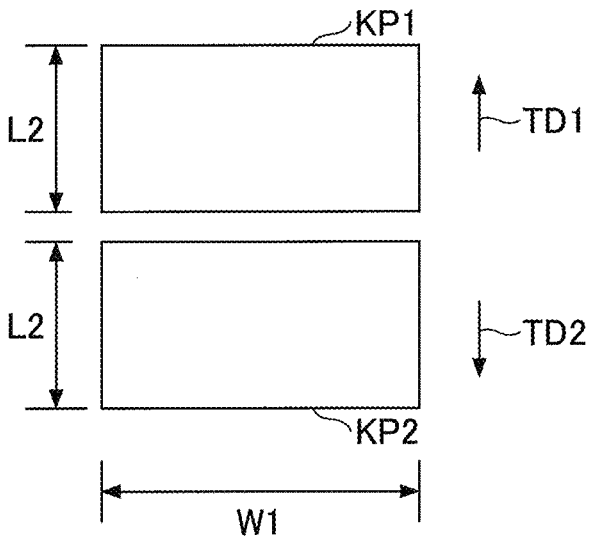
FIG. 9 is a drawing illustrating a usage state (after being cut off) of the hygienic tissue paper according to the second embodiment.
Figure 10:
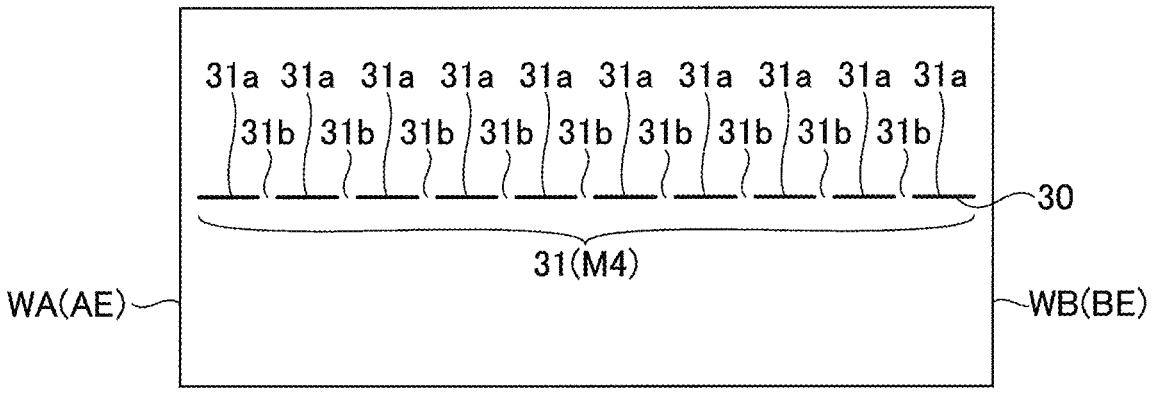
FIG. 10 is a drawing illustrating conventional hygienic tissue paper.

As illustrated in FIGS. 8 and 9, in the kitchen paper KP that has been cut in such a way, the kitchen paper KP can be further split toward a TD1 direction and a TD2 direction along the third perforation 21 (M3) of the second slit 20 (see FIGS. 8 and 9). Then, as illustrated in FIG. 9, the split kitchen paper KP is to be kitchen paper KP1 and kitchen paper KP2 with being cut off at the predetermined interval L2. Thus, according to the second embodiment, the convenience of the hygienic tissue paper 100 is further improved.

As in the second embodiment, the cut length C3 of the third perforation 21 (M3) is configured to be the same as or shorter than the cut length C1 of the first perforation 11 (M1), so that the second slit 20 is not more easily cut than the first slit 10 when the hygienic tissue paper 100 (KP) is cut off. That is, the first slit 10 is more easily cut than the second slit 20. With such a configuration, in the second embodiment, the hygienic tissue paper 100 can be cut along the first slit 10 such that the second slit 20 is left in the kitchen paper KP that has been cut off.

EXAMPLES

In the following, the present invention will be described specifically with reference to examples. Measurement and evaluation of each example and each comparative example were performed as follows.

(Basis Weight of the Hygienic Tissue Paper)

The basis weight (g/m$^2$) of the crepe paper (i.e., raw paper) of the hygienic tissue paper (e.g., the kitchen paper) was calculated in accordance with JIS P 8124 (1998). The basis weight was calculated as the basis weight per single ply.

<Cutting Test>

The kitchen paper 100 (e.g., the kitchen roll) was set on the holder (base shape: circular, base diameter: 120 mm, base thickness: 15 mm, support bar height: 300 mm, and support bar diameter: 15 mm) (i.e., the support bar RS was inserted into the paper tube PT of the kitchen roll). After holding the front end of the kitchen roll with one hand and pulling out the kitchen paper KP (i.e., the sheet ST) in the PD direction, the sheet ST was pulled straight downward at the predetermined interval L1. This operation was performed five times for each example and each comparative example, and the easiness of the kitchen paper KP (i.e., the sheet ST) to be cut at this time was evaluated according to the following three levels.

3: The kitchen paper KP could be cut off at the point to be cut.

2: The kitchen paper KP could be cut off at the point to be cut, but there were times when the kitchen paper KP could not be cut out completely.

1: The kitchen paper KP could not be cut off at the point to be cut.

<Tensile Test>

A test piece on which the first slit 10 or the second slit 20 was formed approximately at the middle of the kitchen paper KP (i.e., the sheet ST) in the longitudinal direction (i.e., the Y direction), was prepared. The dimensions of the test piece were approximately 228 mm in the width direction (i.e., the X direction) (which is the cut size), approximately 220 mm in the longitudinal direction (i.e., the Y direction) (which is the sheet size), and approximately 110 mm from the end to the middle in the longitudinal direction (i.e., Y direction). A tensile test was performed on the test piece. In the test, a push pull gauge ("Z2-20 N" manufactured by IMADA Co., Ltd) was attached to a tensile tester ("MX-500N" manufactured by IMADA Co., Ltd). A clip was attached to the push pull gauge. The dimensions of the clip were approximately 30 mm in length and approximately 21 mm in width. The clip was attached to the test piece. The clips were attached to both ends of the test piece in the longitudinal direction (i.e., the Y direction) such that a front end of the clip is approximately 13 mm away from each end of the test piece in the longitudinal direction (i.e., Y direction), and one side end of the clip is approximately 5 mm away from one end of the test piece in the width direction (i.e., the X direction). The tensile test was performed on this condition, and an average value of peak tensile strength (kgf) measured three times at 145 mm/min was calculated.

In the following, examples and comparative examples will be described.

Example 1

The basis weight (single ply) of the hygienic tissue paper (e.g., the kitchen paper) was approximately 21 g/m$^2$. With respect to the dimensions of the kitchen paper (i.e., the kitchen roll), the roll diameter R1 was approximately 110 mm, the roll width W1 was approximately 280 mm, the predetermined intervals L1 and L2 were approximately 220 mm, and the thickness (2-ply) was approximately 350 μm. The first slits 10 extending in the width direction (i.e., the X direction) were disposed in the longitudinal direction (i.e., the Y direction) at the predetermined intervals L1. The second slit 20 extending in the width direction (i.e., the X direction) was alternately disposed with each of the first slits 10 and the second slits 20 were disposed in the direction (i.e., the Y direction) at the predetermined intervals L2. In the first slit 10, the first perforation 11 (M1) was formed on each of the one end WA side and the other end WB side, and the second perforation 12 (M2) was formed on the central portion WC. In the second slit 20, the third perforation 21 (M3) was formed. In the first perforation 11 (M1), the cut length C1 was approximately 6.6 mm, the tie length T1 was approximately 0.5 mm, the cut-tie ratio CT1 was approximately 93.0, and the edge cut length of both ends in the width direction (i.e., the X direction) was approximately 0.5 mm. In the second perforation 12 (M2), the cut length C2 was approximately 13.2 mm, the tie length T2 was approximately 0.5 mm, and the cut-tie ratio CT2 was approximately 96.4. In the third perforation 21 (M3), the cut length C3 was approximately 6.6 mm, the tie length T3 was approximately 0.5 mm, the cut-tie ratio CT3 was about 93.0, and the edge cut length of both ends in the width direction (i.e., the X direction) was approximately 0.5 mm. The conditions and results of Example 1 are shown in Table 1.

Example 2

Conditions were similar to the conditions of Example 1 except that in the first perforation 11 (M1), the cut length C1 was approximately 5.0 mm, the tie length T1 was approximately 1.0 mm, and the cut-tie ratio CT1 was approximately 83.3, and in the second perforation 12 (M2), the cut length C2 was approximately 10.0 mm, the tie length T2 was approximately 1.0 mm, and the cut-tie ratio CT2 was approximately 90.9, and in the third perforation 21 (M3), the cut length C3 was approximately 5.0 mm, the tie length T3 was approximately 1.0 mm, and the cut-tie ratio CT3 was approximately 83.3. The conditions and results of Example 2 are shown in Table 1.

Example 3

Conditions were similar to the conditions of Example 1 except that in the first perforation 11 (M1), the cut length C1 was approximately 6.0 mm, the tie length T1 was approximately 0.5 mm, and the cut-tie ratio CT1 was approximately 92.3, and in the second perforation 12 (M2), the cut length C2 was approximately 12.0 mm, the tie length T2 was approximately 0.5 mm, and the cut-tie ratio CT2 was approximately 96.0, and in the third perforation 21 (M3), the cut length C3 was approximately 6.0 mm, the tie length T3 was approximately 0.5 mm, and the cut-tie ratio CT3 was approximately 92.3. The conditions and results of Example 3 are shown in Table 1.

Example 3

Conditions were similar to the conditions of Example 1 except that in the first perforation 11 (M1), the cut length C1 was approximately 7.5 mm, the tie length T1 was approximately 1.0 mm, and the cut-tie ratio CT1 was approximately 88.2, and in the second perforation 12 (M2), the cut length C2 was approximately 15.0 mm, the tie length T2 was approximately 1.0 mm, and the cut-tie ratio CT2 was approximately 93.8, and in the third perforation 21 (M3), the cut length C3 was approximately 7.5 mm, the tie length T3 was approximately 1.0 mm, and the cut-tie ratio CT3 was approximately 88.2. The conditions and results of Example 4 are shown in Table 1.

Comparative Example 1

Conditions were similar to the conditions of Example 1 except that only a first slit 30 was disposed, and only a first perforation 31 (M4) was formed in the first slit 30, and the cut length C1 was approximately 6.6 mm, the tie length T1 was approximately 0.5 mm, and the cut-tie ratio CT1 was approximately 93.0, and the edge cut portion was not provided. The conditions and results of Comparative Example 1 are shown in Table 1.

Comparative Example 2

Conditions were similar to the conditions of Example 1 except that the basis weight (single ply) of the hygienic tissue paper (e.g., the kitchen paper) was approximately 22 g/m$^2$, the predetermined interval L1 (i.e., the sheet size) was approximately 230 mm, the cut length C1 was approximately 5.0 mm, the tie length T1 was approximately 1.0 mm, and the cut-tie ratio CT1 was approximately 83.3. The conditions and results of Comparative Example 2 are shown in Table 1.

TABLE 1

| | EXAMPLE 1 | EXAMPLE 2 | EXAMPLE 3 | EXAMPLE 4 | COMPARATIVE EXAMPLE 1 | COMPARATIVE EXAMPLE 2 |
|---|---|---|---|---|---|---|
| BASIS WEIGHT (g/m$^2$) | 21 | 21 | 21 | 21 | 21 | 22 |
| CUT SIZE | 228 | 228 | 228 | 228 | 228 | 228 |
| SHEET SIZE | 220 | 220 | 220 | 220 | 220 | 230 |
| FIRST SLIT | | | | | | |
| FIRST PERFORATION | | | | | | |
| CUT LENGTH C1 (mm) | 6.6 | 5.0 | 6.0 | 7.5 | 6.6 | 5.0 |
| TIE LENGTH T1 (mm) | 0.5 | 1.0 | 0.5 | 1.0 | 0.5 | 1.0 |
| TIE-CUT RATIO TC1 | 0.076 | 0.200 | 0.083 | 0.133 | 0.076 | 0.200 |
| CUT-TIE RATIO CT1 | 93.0 | 83.3 | 92.3 | 88.2 | 93.0 | 83.3 |
| EDGE CUT LENGTH (mm) | 0.5 | 0.5 | 0.5 | 0.5 | — | — |
| SECOND PERFORATION | | | | | | |
| CUT LENGTH C2 (mm) | 13.2 | 10.0 | 12.0 | 15.0 | — | — |
| TIE LENGTH T2 (mm) | 0.5 | 1.0 | 0.5 | 1.0 | — | — |
| TIE-CUT RATIO TC2 | 0.038 | 0.100 | 0.042 | 0.067 | — | — |
| CUT-TIE RATIO CT2 | 96.4 | 90.9 | 96.0 | 93.8 | — | — |
| SECOND SLIT | | | | | | |
| THIRD PERFORATION | | | | | | |
| CUT LENGTH C3 (mm) | 6.6 | 5.0 | 6.0 | 7.5 | — | — |
| TIE LENGTH T3 (mm) | 0.5 | 1.0 | 0.5 | 1.0 | — | — |
| TIE-CUT RATIO TC3 | 0.076 | 0.200 | 0.083 | 0.133 | — | — |
| CUT-TIE RATIO CT3 | 93.0 | 83.3 | 92.3 | 88.2 | — | — |
| EDGE CUT LENGTH (mm) | 0.5 | 0.5 | 0.5 | 0.5 | — | — |
| PROPERTY FOR BEING CUT | 3 | 3 | 3 | 3 | 2 | 2 |
| TENSILE STRENGTH OF FIRST SLIT (kgf) | 0.352 | 0.377 | 0.365 | 0.369 | 0.565 | 0.670 |

TABLE 1-continued

| | EXAMPLE 1 | EXAMPLE 2 | EXAMPLE 3 | EXAMPLE 4 | COMPARATIVE EXAMPLE 1 | COMPARATIVE EXAMPLE 2 |
|---|---|---|---|---|---|---|
| TENSILE STRENGTH OF SECOND SLIT (kgf) | 0.593 | 0.677 | 0.620 | 0.657 | 0.565 | 0.670 |

From Table 1, the evaluation of property for being cut was 3 for the kitchen paper 100 configured such that, in the first slit 10, the cut length C2 of the second perforation 12 (M2) formed on the central portion WC in the width direction (i.e., X direction) is longer than the cut length C1 of the first perforation 11 (M1) formed on the one end WA or the other end WB side in the width direction (i.e., the X direction) (Examples 1 to 4).

With respect to the above, the evaluation of the property for being cut was 2 for the kitchen paper 100 configured such that, in the first slit 10, only the first perforation 11 (M1) was formed and the second perforation 12 (M2) was not formed (Comparative Examples 1 and 2).

Additionally, in Comparative Examples 1 and 2, the tensile strength of the first slit 10 exceeded 0.5 kgf, while in Examples 1 to 4, the tensile strength was smaller than or equal to 0.5 kgf. Further, when a value of the tensile strength (kgf) of the first slit 10 and a value of the tensile strength (kgf) of the second slit 20 were compared, the same values (kgf) were observed in Comparative Examples 1 and 2, while the value of the first slit 10 was smaller than the value of the second slit 20 in Examples 1 to 4.

These results indicate that hygienic tissue paper that is easy to be cut can be obtained by arranging the first slits extending in the width direction (i.e., the X direction) at predetermined intervals in the longitudinal direction (i.e., the Y direction) and increasing the cut length of each of the perforations constituting the first slit, from at least one end in the width direction (i.e., the X direction) toward the central portion.

The preferred embodiments of the invention have been described in detail above, but the invention is not limited to any specific embodiment, and various modifications and variations can be made within the scope of the invention as recited in the claims.

In the following, preferred examples of the present invention will be additionally described.

A first example according to the present invention provides hygienic tissue paper including first slits that are disposed in the longitudinal direction at predetermined intervals and that extend in the width direction intersecting the longitudinal direction, wherein the first slits each include perforations, and the cut length of each of the perforations increases from at least one end in the width direction toward the central portion in the width direction.

In the present specification, the perforation has a structure in which a portion that is cut (which will be hereinafter referred to as a cut portion) and a portion that is not cut (which will be hereinafter referred to as a tie portion) between two adjacent cut portions are alternately disposed. The cut length is the length in the width direction of the cut portion constituting the perforation.

In the first example, the first slits that are disposed in the longitudinal direction at the predetermined intervals and that extend in the width direction intersecting the longitudinal direction, are formed in the hygienic tissue paper. The first slit includes the perforations, and the cut length of each of the perforations increases from at least one end in the width direction toward the central portion in the width direction.

In such a configuration, the hygienic tissue paper starts to be cut from at least one end in the width direction and a cutting direction proceeds toward the central portion in the width direction. At this time, the cutting direction is gradually stabilized as the cutting direction proceeds from the perforation at the one end side that has a short cut length toward the perforation at the central portion that has a long cut length. Even when the cutting proceeds to reach the other end side in the width direction from the central portion, the cutting can proceed with the cutting direction being stable.

Thus, in the first example, the hygienic tissue paper can be cut at a position where the perforations are formed even when the hygienic tissue paper is not fixed or is unstable (for example, when the hygienic tissue paper is cut from a tissue paper roll which is rotatably mounted on a holder or the like, when the hygienic tissue paper is cut by one hand without the hygienic tissue paper being pressed, and so on). Therefore, in the first example, when the hygienic tissue paper is cut, the hygienic tissue paper is not easily torn and extra hygienic tissue paper can be prevented from being pulled out. Therefore, according to the first example, the hygienic tissue paper that is easy to be cut can be provided.

A second example of the present invention provides hygienic tissue paper in which the first slit includes a first perforation formed on at least the one end side and a second perforation formed on the central portion, and the cut length of the second perforation is longer than the cut length of the first perforation.

In the second example, the first slit includes a first perforation formed on at least one end in the width direction and a second perforation formed on the central portion. The cut length of the second perforation is longer than the cut length of the first perforation.

With such a configuration, in a second example, as in the first example, the cut length of each of the perforations can increase from at least one end in the width direction toward the central portion in the width direction. Also, when hygienic tissue paper is cut, a force applied to the perforations is easily transmitted from the first perforation to the second perforation. This can further prevent the perforations from being torn in an unexpected direction and prevent extra hygienic tissue paper from being pulled out without the perforations being cut.

A third example of the invention provides hygienic tissue paper in which a cut-tie ratio of the first perforation is preferably 80.0 to 96.0. Here, the cut-tie ratio of the first perforation is a ratio of the cut portion length to unit length that is the length of the cut portion and the tie portion adjacent to the cut portion in the direction in which the first perforation extends, where the unit length is 100. The cut-tie ratio of the first perforation is preferably 81.0 to 95.0, and more preferably 82.0 to 94.0.

In the third example, the cut-tie ratio of the first perforation is configured to be in such a range, so that a force applied to the perforations can be easily transferred from the first perforation to the second perforation when the hygienic tissue paper is cut off. Thus, the third example can further prevent the perforations from being torn in an unexpected direction and prevent extra hygienic tissue paper from being pulled out without the perforations being cut.

A fourth example of the invention provides hygienic tissue paper in which the cut-tie ratio of the second perforation is preferably 87.0 to 99.0. Here, the cut-tie ratio of the second perforation is a ratio of the cut portion length to unit length that is the length of the cut portion and the tie portion adjacent to the cut portion in the direction in which the second perforation extends, where the unit length is 100. The cut-tie ratio of the second perforation is more preferably 88.0 to 98.0, further more preferably 89.0 to 97.0.

In the fourth example, the cut-tie ratio of the second perforation is configured to be in such a range, so that a force applied to the perforations can be easily transferred from the first perforation to the second perforation when the hygienic tissue paper is cut off. Thus, the fourth example further prevent the perforations from being torn in an unexpected direction and prevent extra hygienic tissue paper from being pulled out without the perforations being cut.

A fifth example of the present invention provides hygienic tissue paper in which the first perforation includes at least an edge cut that continues from an edge of the one end. That is, in the fifth example, at least the edge cut which continues from the edge of the one end in the width direction, is provided in the first perforation.

With such a configuration, in the fifth example, when the hygienic tissue paper is cut off, a force applied to the perforations can be easily transmitted from the edge of the one end to the first perforation. Therefore, according to the fifth aspect, when the hygienic tissue paper is cut, the entire perforations are easily cut and the hygienic tissue paper is further easily cut.

A sixth example of the invention provides hygienic tissue paper in which the ratio of the edge cut length of the edge cut portion to the cut length of the first perforation is preferably 0.02 to 0.16. Here, the ratio of the edge cut length of the edge cut portion to the cut length of the first perforation indicates a ratio of the edge cut length of the edge cut portion when the cut length of the first perforation is 1. The ratio of the edge cut length of the edge cut portion to the cut length of the first perforation is more preferably 0.05 to 0.13, and further more preferably 0.07 to 0.11.

In the sixth example, the ratio of the edge cut length of the edge cut portion to the cut length of the first perforation is configured to be in such a range, so that when hygienic tissue paper is cut off, a force applied to the perforations is easily transferred from the edge of the one end to the first perforation. Thus, according to the sixth example, when the hygienic tissue paper is cut, the entire perforations are more easily cut and the hygienic tissue paper is more easily cut off.

With such a configuration, in the sixth example, at least one edge cut portion that continues from the edge of the one end in the width direction of the hygienic tissue paper is not easily turned over. Therefore, according to the sixth example, unexpected breaks or product defects of the hygienic tissue paper during the manufacturing or packaging process of the hygienic tissue paper can be avoided.

A seventh example of the present invention provides hygienic tissue paper in which the cut length of each of the perforations increases from the other end facing the one end in the width direction toward the central portion. In the seventh example, in the first slit, the cut length of each of the perforations increases from the other end facing the one end in the width direction toward the central portion.

With such a configuration, in the seventh example, the hygienic tissue paper can be cut from either one end or the other end of the hygienic tissue paper when the hygienic tissue paper is cut in the unfixed or unstable state as described above. Therefore, according to the seventh example, the convenience of the hygienic tissue paper is improved.

An eighth example of the present invention provides hygienic tissue paper that includes a second slit alternately disposed with each of the first slits in the longitudinal direction at a predetermined interval and extending in the width direction intersecting the longitudinal direction, wherein the second slit includes a third perforation, and the cut length of the third perforation is the same as the cut length of the first perforation in the first slit, or is shorter than the cut length.

In the eighth example, the second slit extending in the width direction intersecting the longitudinal direction is further alternately disposed with each of the first slits in the longitudinal direction at the predetermined interval. Additionally, the second slit includes the third perforation and the cut length of the third perforation is the same as the cut length of the first perforation in the first slit, or is shorter than the cut length.

With such a configuration, in the eighth example, the second slit (the third perforation) is left in the hygienic tissue paper cut along the first slit (the first perforation and second perforation). This enables the cut hygienic tissue paper to be split along the third perforation of the second slit. Thus, according to the eighth example, the convenience of the hygienic tissue paper is further improved.

Additionally, in the eighth example, the cut length of the third perforation is the same as or is shorter than the cut length of the first perforation, so that the second slit is not easy to be cut than the first slit when the hygienic tissue paper is cut off. That is, the first slit is more easily cut than the second slit. Therefore, according to the eighth example, the hygienic tissue paper can be cut off at the first slit with the second slit being remained.

The present application is based on and claims priority to Japanese Patent Application No. 2018-57879, filed Mar. 26, 2018, the entire contents of which are incorporated herein by reference.

REFERENCE SIGNS LIST

100 (KP) hygienic tissue paper (kitchen paper)
L1 interval
L2 interval
WA one end
AE edge
WB the other end
BE edge
WC central portion
M perforation
C cut length
10 first slit
11 (M1) first perforation
11*a* cut portion
11*b* tie portion
11*c* edge cut portion
11*d* edge cut portion
C1 cut length
T1 tie length
12 (M2) second perforation
12*a* cut portion
12*b* tie portion C2 cut length
T2 tie length
second slit
21 (M3) third perforation
21*a* cut portion
21*b* tie portion
21*c* edge cut portion
21*d* edge cut portion
C3 cut length
T3 tie length

The invention claimed is:

1. A hygienic tissue paper comprising
first slits that are disposed in a longitudinal direction at predetermined intervals, the first slits extending in a width direction intersecting the longitudinal direction,
wherein the first slits each include perforations,
wherein a cut length of each of the perforations increases from at least one end in the width direction toward a central portion in the width direction,
wherein the first slits each include a first perforation formed on at least one end side and a second perforation formed on the central portion,
wherein a cut length of the second perforation is greater than a cut length of the first perforation,
wherein the second perforation is an only perforation formed on the central portion, and
wherein the cut length of the first perforation is 5 mm to 7.5 mm, and the cut length of the second perforation is 10 mm to 15 mm.

2. The hygienic tissue paper as claimed in claim 1,
wherein a cut-tie ratio of the first perforation is 80.0 to 96.0.

3. The hygienic tissue paper as claimed in claim 1,
wherein a cut-tie ratio of the second perforation is 87.0 to 99.0.

4. The hygienic tissue paper as claimed in claim 1,
wherein the first perforation includes at least an edge cut portion that continues from an edge of the one end.

5. The hygienic tissue paper as claimed in claim 4,
wherein a ratio of an edge cut length of the edge cut portion to the cut length of the first perforation is 0.02 to 0.16.

6. The hygienic tissue paper as claimed in claim 1,
wherein the cut length of each of the perforations increases from another end toward the central portion, the another end facing the one end in the width direction.

7. The hygienic tissue paper as claimed in claim 1, comprising
a second slit that is alternately disposed with each of the first slits in the longitudinal direction at a predetermined interval, the second slit extending in the width direction intersecting the longitudinal direction,
wherein the second slit includes a third perforation, and
wherein a cut length of the third perforation is equal to or shorter than the cut length of the first perforation in each of the first slits.

* * * * *